US012024967B1

(12) United States Patent
Quero

(10) Patent No.: US 12,024,967 B1
(45) Date of Patent: Jul. 2, 2024

(54) METHOD AND APPARATUS TO PERFORM SECTION MILLING

(71) Applicant: Halliburton Energy Services, Inc., Houston, TX (US)

(72) Inventor: Philippe Quero, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/083,241

(22) Filed: Dec. 16, 2022

(51) Int. Cl.
*E21B 29/00* (2006.01)

(52) U.S. Cl.
CPC ..... *E21B 29/005* (2013.01)

(58) Field of Classification Search
CPC .... E21B 33/1295; E21B 23/04; E21B 43/112; E21B 29/005
See application file for complete search history.

(56) References Cited

U.S. PATENT DOCUMENTS

| | | | | |
|---|---|---|---|---|
| 7,478,687 | B2 | 1/2009 | Ynde et al. | |
| 10,450,846 | B2 | 10/2019 | Jabs et al. | |
| 10,876,377 | B2 | 12/2020 | Quero et al. | |
| 11,299,938 | B2 | 4/2022 | Quero et al. | |
| 11,371,940 | B2 | 6/2022 | Stark et al. | |
| 2002/0162659 | A1* | 11/2002 | Davis | E21B 29/005 166/361 |
| 2014/0251616 | A1 | 9/2014 | O'Rourke et al. | |
| 2020/0362655 | A1 | 11/2020 | McGarian | |
| 2021/0088447 | A1 | 3/2021 | Stark et al. | |
| 2021/0131276 | A1 | 5/2021 | LeBlanc et al. | |
| 2021/0148189 | A1 | 5/2021 | Strangeland | |
| 2021/0198955 | A1 | 7/2021 | Wardley | |
| 2022/0213778 | A1* | 7/2022 | Liu | E21B 45/00 |
| 2022/0389796 | A1 | 12/2022 | Low et al. | |

FOREIGN PATENT DOCUMENTS

| | | |
|---|---|---|
| EP | 2655786 B1 | 5/2017 |
| JP | 2001020650 A | 1/2001 |
| WO | 2004046499 | 6/2004 |
| WO | 2021112844 | 6/2021 |
| WO | 2021112846 | 6/2021 |

OTHER PUBLICATIONS

International Search Report and Written Opinion for PCT/US2023/010338 dated Sep. 8, 2023.

* cited by examiner

*Primary Examiner* — Christopher J Sebesta
*Assistant Examiner* — Lamia Quaim
(74) *Attorney, Agent, or Firm* — Thomas Rooney; C. Tumey Law Group PLLC

(57) ABSTRACT

A section milling system may include an anchor secured to a downhole end of a coiled tubing. The anchor is configured to expand radially outward to set the anchor at a desired downhole position and restrain rotation of the coiled tubing. The section milling system also includes a reamer positioned downhole from the anchor. The reamer having extendable cutting arms configured to extend in response to fluid flowing through the reamer. Additionally, the section milling system includes a motor configured to rotate in response to fluid flowing through the motor, and rotation of the motor is configured to drive rotation of the cutting arms of the reamer to mill wellbore casing positioned adjacent the reamer. The section milling system further includes an actuation feature configured to move the reamer to mill along a wellbore in the uphole direction.

19 Claims, 7 Drawing Sheets

METHOD AND APPARATUS TO PERFORM SECTION MILLING

BACKGROUND

After drilling a wellbore in a subterranean formation for recovering hydrocarbons such as oil and gas lying beneath the surface, a casing string may be fed into the wellbore. Generally, the casing string protects the wellbore from failure (e.g., collapse, erosion) and provides a fluid path for hydrocarbons during production. Further, cement may be pumped into the annular space between the casing and the wellbore to form a seal. To access the hydrocarbons for production, a perforating gun system may be deployed into the casing string to form perforations in the casing and/or cement such that hydrocarbons may flow into the casing string via the perforation. Once production operations have concluded, plug and abandonment (P&A) operations may be conducted. In some cases, the seal formed by the casing and/or cement may erode or be otherwise compromised during production operations, such that there may be flows, crossflows, or seepage of water, gas, or oil through the seal. As such, the P&A operations may include performing section milling operations at compromised locations to remove casing, tubing, and/or cement such that new isolations may be placed to ensure a suitable seal.

Traditionally, section milling is performed by lowering a section milling system into a wellbore via jointed pipe that is supported by a drilling rig. However, using a drilling rig is expensive and time consuming. To reduce costs, some section milling systems are lowered into the wellbore via coiled tubing. Unfortunately, these section milling systems may have failure issues dues to reactionary forces (e.g., tension, compression, torque) transmitted to the coiled tubing during section milling operations at some depths, which may reduce or negate the cost and time benefits of using coiled tubing over jointed pipe for section milling operations.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for performing section milling and, more particularly, example embodiments may include a section milling system that is lowered into the wellbore, via coiled tubing, which may reduce costs associated with running the section milling system with jointed pipe and a drill rig. The coiled tubing may be coupled to an anchor of the section milling system, which is configured to selectively set or anchor against casing disposed in the wellbore. As set forth in greater detail below, the anchor in combination with other features of the section milling system, may be configured to absorb the reactionary forces from section milling operations, to prevent or reduce (e.g., tension, compression, torque) transmitted to the coiled tubing.

Figure 1:
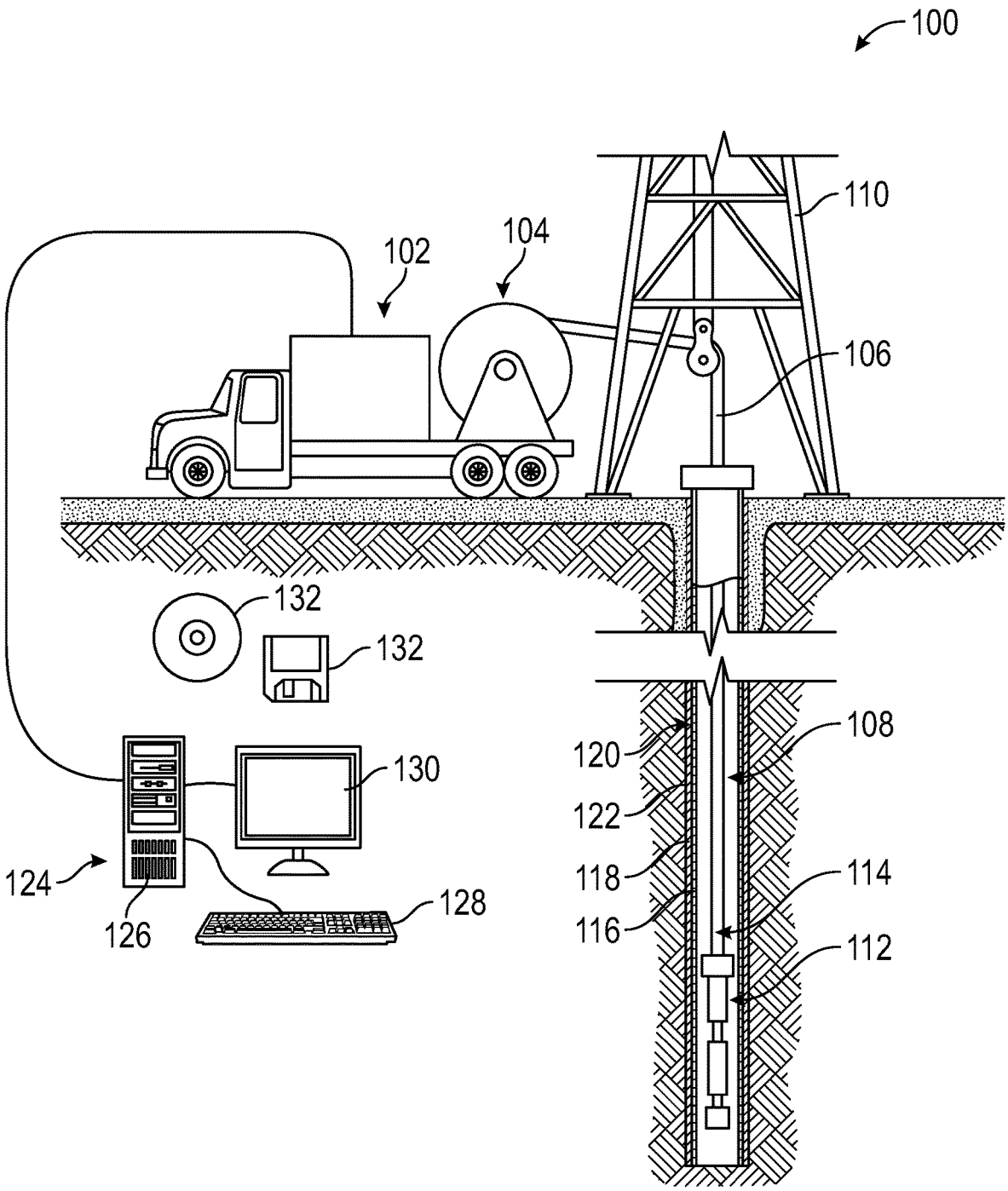
FIG. 1 illustrates an elevation view of a well system, in accordance with some embodiments of the present disclosure.

FIG. 1 illustrates a cross-sectional view of a well system 100, in accordance with one or more embodiments of the disclosure. It should be noted that while FIG. 1 generally depicts a land-based operations, those skilled in the art will readily recognize that the principles described herein are equally applicable to subsea operations that employ floating or sea-based platforms and rigs, without departing from the scope of the disclosure. As illustrated, well system 100 may comprise a vehicle 102 (e.g., mounted truck coiled tubing unit) or any suitable surface system 104 for raising and lowering coiled tubing 106 in a wellbore 108. Although the illustrated embodiment shows a drilling rig 110 supporting the coiled tubing 106, the vehicle 102 may be configured to run the coiled tubing 106 without a drilling rig 110. Further, a section milling system 112 may be coupled to downhole end 114 of the coiled tubing 106 such that, during plug and abandonment operations, the coiled tubing 106 may lower the section milling system 112 into the wellbore 108 to a desired location for performing section milling operations.

Generally, the wellbore 108 may be lined with casing 116, and cement 118 may be pumped into an annulus 120 between the casing 116 and a wellbore wall 122 to protect the wellbore 108 from failure (e.g., collapse, erosion) and to provide a fluid path for hydrocarbons during production. However, in some cases, the seal formed by the casing 116 and/or cement 118 may erode or be otherwise compromised during production operations, such that there may be flows, crossflows, or seepage of water, gas, or oil through the seal. As such, during plug and abandonment operations, the coiled tubing 106 may lower the section milling system 112 into the wellbore 108 to desired locations (e.g., compromised locations) to remove casing 116, tubing, and/or cement 118 such that new isolations (e.g., casing, cement, etc.) may be placed to ensure a suitable seal.

Moreover, during section milling operations, the well system 100 may relay information between the surface and the section milling system 112. In particular, the well system 100 may further include an information handling system 124 configured to process information gathered by the section milling system 112. For example, sensor data recorded by section milling system 112 may be communicated to and then processed by information handling system 124. Without limitation, the processing may be performed in real-time. Processing may alternatively occur downhole or may occur both downhole and at the surface. The sensor data recorded by section milling system 112 may be conducted to information handling system 124 via coiled tubing 106 or any suitable transmission medium. Information handling system 124 may process the signals, and the information contained therein may be displayed for an operator to observe and stored for future processing and reference. Information handling system 124 may also contain an apparatus for supplying control signals to section milling system 112.

Information handling system 124 may include any instrumentality or aggregate of instrumentalities operable to compute, estimate, classify, process, transmit, receive, retrieve, originate, switch, store, display, manifest, detect, record, reproduce, handle, or utilize any form of information, intelligence, or data for business, scientific, control, or other purposes. For example, an information handling system 124 may be a processing unit 126, a network storage device, or any other suitable device and may vary in size, shape, performance, functionality, and price. Information handling system 124 may include random access memory (RAM), one or more processing resources such as a central processing unit (CPU) or hardware or software control logic, ROM, and/or other types of nonvolatile memory. Additional components of the information handling system 124 may include one or more disk drives, one or more network ports for communication with external devices as well as various input and output (I/O) devices, such as an input device 128 (e.g., keyboard, mouse, etc.) and a display 130. Information handling system 124 may also include one or more buses operable to transmit communications between the various hardware components.

Alternatively, systems and methods of the present disclosure may be implemented, at least in part, with non-transitory computer-readable media 132. Non-transitory computer-readable media 132 may include any instrumentality or aggregation of instrumentalities that may retain data and/or instructions for a period of time. Non-transitory computer-readable media 132 may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Figure 2C:
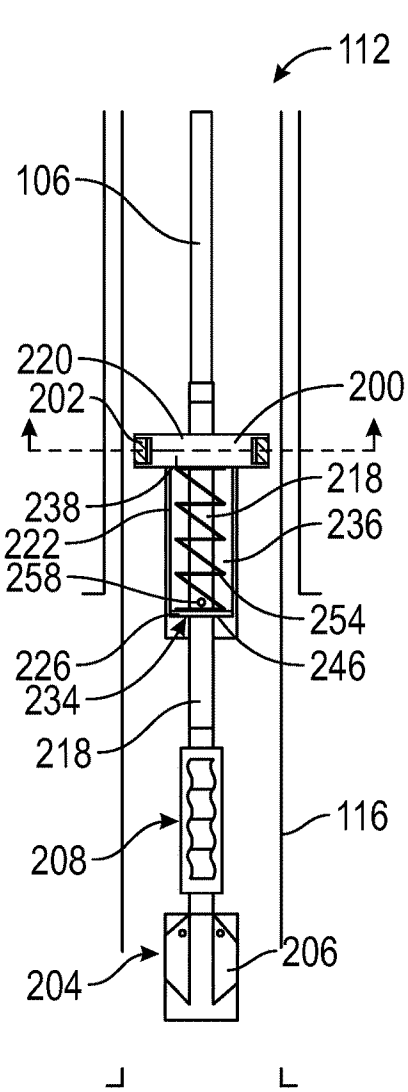
FIGS. 2A-C illustrate respective side views of a section milling system, in accordance with some embodiments of the present disclosure.
Figure 2B:
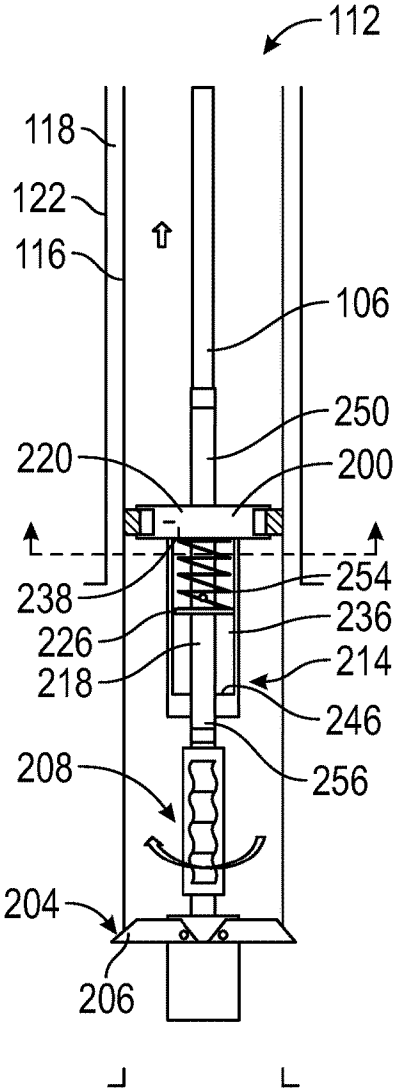
Figure 2A:
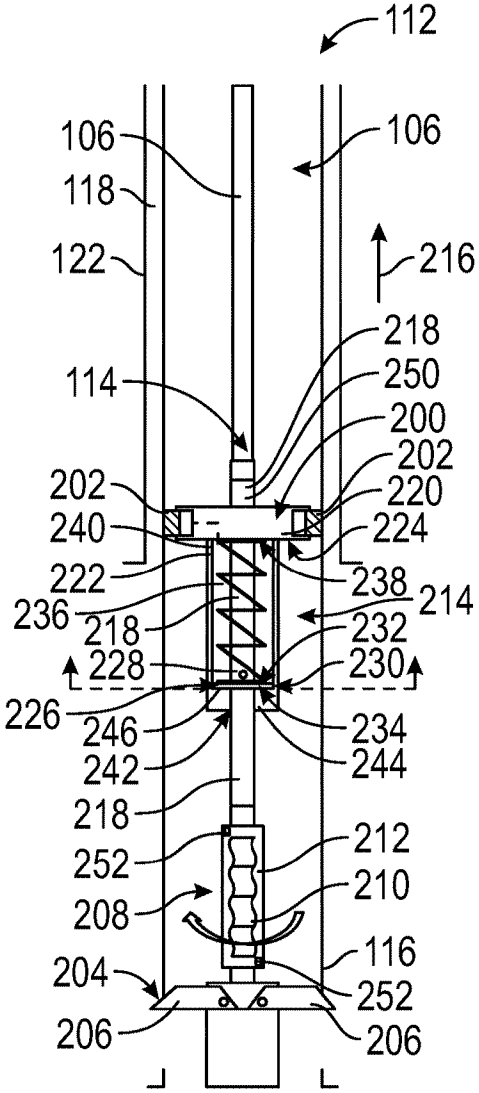

FIGS. 2A-C illustrate respective side views of the section milling system 112, in accordance with some embodiments of the present disclosure. In particular, FIG. 2A illustrates the section milling system 112 in a set state. During plug and abandonment (P&A) operations, the section milling system 112 is lowered into the wellbore 108 to a desired position for section milling operations. Specifically, as set forth above, the section milling system 112 is lowered into the wellbore 108 via the coiled tubing 106. The section milling system 112 comprises an anchor 200 secured to the downhole end 114 of the coiled tubing 106. Once the coiled tubing 106 lowers the anchor 200 into a wellbore 108 to a desired position, the anchor 200 is configured to expand radially outward to set the anchor 200 at the desired position and restrain rotation of the coiled tubing 106 during section milling operations. Restraining rotation of the coiled tubing 106 may reduce reactionary forces exerted on the coiled tubing 106 from performing the section milling, which may reduce the risk of failure of the coiled tubing 106 during the section milling operation.

As illustrated, the anchor 200 may include hydraulic pads 202 configured to expand radially outward to set or secure the anchor 200 at the desired position in the wellbore 108. However, any suitable mechanism may be used to set the anchor 200. With the anchor 200 in the desired position, fluid may be pumped from the surface and into the section milling system 112 via the coiled tubing 106 to set the anchor 200. Specifically, fluid is pumped into the section milling system 112 at a first rate, which is configured to apply sufficient pressure to actuate the hydraulic pads 202 radially outward against the casing 116 at the desired position to set the anchor 200. Setting the anchor 200 against the casing 116 may restrain both axial and rotational movement of the anchor 200 with respect to the wellbore 108.

The section milling system 112 further includes a reamer 204 positioned downhole from the anchor 200. As illustrated, the reamer 204 may be indirectly coupled to the anchor 200. The reamer 204 includes a plurality of extendable cutting arms 206 configured to extend radially outward in response to a sufficient rate of fluid flow through the reamer 204 (e.g., a second flow rate). The second flow rate may be greater than the first flow rate such that the anchor 200 may set before the cutting arms 206 actuate to an extended position. In the extended position, the cutting arms 206 are configured to engage the casing 116.

Moreover, the section milling system 112 includes a motor 208 configured to activate (e.g., rotate) in response to fluid flow through the motor 208 from the coiled tubing 106. As illustrated, the motor 208 may be disposed between the reamer 204 and the anchor 200. The motor 208 may comprise a downhole mud motor 208 having a rotor 210 disposed in a rotor housing 212. In response to fluid flow through the rotor housing 212, the rotor 210 is configured to rotate with respect to the rotor housing 212. Further, the motor 208 may be coupled to the reamer 204 such that rotation of the rotor 210 drives the reamer 204. Specifically, rotation of the rotor 210 may be configured to drive rotation of the cutting arms 206 of the reamer 204 in the extended position such that the cutting arms 206 may mill the wellbore casing 116, the cement 118, and or the wellbore wall 122 positioned adjacent the reamer 204. Moreover, the rotor 210 may be configured to rotate at both the first and second flow rate. However, during milling operations, fluid may flow at the second flow rate to hold the cutting arms 206 in the extended position such that the motor 208 may rotate based on the second flow rate to drive the reamer 204.

The section milling system 112 further includes an actuation feature 214 configured to move the reamer 204 in an uphole direction 216 with respect to the anchor 200 to mill along the wellbore 108 in the uphole direction 216. That is, with the cutting arms 206 in the extended position and the motor 208 driving rotation of the cutting arms 206, the actuation feature 214 may pull the reamer 204 in the uphole direction 216 such that the cutting arms 206 may mill the wellbore casing 116, the cement 118, and/or the wellbore wall 122 as the reamer 204 moves uphole. In some embodiments, the actuation feature 214 may include a downhole system (e.g., hydraulic stroker) configured to move the reamer 204 in the uphole direction 216. However, in the illustrated embodiment, the actuation feature comprises the surface system 104 (e.g., a coiled tubing unit) configured to move the coiled tubing 106 uphole. The reamer 204 may be indirectly coupled to the coiled tubing 106 such that uphole movement of the coiled tubing 106 moves the reamer 204 in the uphole direction 216. For example, as illustrated, the reamer 204 may be indirectly coupled to the coiled tubing 106 via the motor 208 and a sliding cylinder 218 of the anchor 200 such that axial movement of the coiled tubing 106 drives axial movement of the reamer 204.

Moreover, in the illustrated embodiment, the anchor 200 comprises a main body 220, a spring housing 222 extending from a downhole end 224 of the main body 220, and a sliding cylinder 218 extending through the main body 220 and the spring housing 222. The sliding cylinder 218 is configured to move axially, with respect to the main body 220 of the anchor 200, between a first position (e.g., downhole position) and a second position (e.g., uphole position).

The sliding cylinder 218 includes a stop plate 226 extending radially outward from a main tubing 228 of the sliding cylinder 218. In the illustrated embodiment, the stop plate 226 comprises a radial protrusion extending radially outward from the main tubing 228. However, in some embodiments, the stop plate 226 may include a separate component that is rigidly secured to the main tubing 228 via welding or any suitable fastening method. In the illustrated embodiment, the stop plate 226 has an annular or disk shape with a radially outer surface 230, an uphole face 232, and a downhole face 234. However, the stop plate 226 may include any suitable shape. Moreover, as illustrated, the stop plate 226 of the sliding cylinder 218 is disposed within a central chamber 236 of the spring housing 222.

The spring housing 222 includes a cylindrical shape with an uphole end 238 secured to the downhole end 224 of the main body 220 of the anchor 200. The spring housing 222 further includes a central chamber 236, which is defined by an inner surface 240 of the spring housing 222. Additionally, the spring housing 222 comprises a through bore 242 extending through a downhole portion 244 of the spring housing 222. The through bore 242 has a larger diameter than the main tubing 228 of the sliding cylinder 218, but a smaller diameter than the stop plate 226 of the sliding cylinder 218 to retain the stop plate 226 within the central chamber 236 of the spring housing 222. In particular, contact between the downhole face 234 of the stop plate 226 and a downhole end 246 of the central chamber 236 (i.e., at the downhole portion of the spring housing 222) restrains downhole movement of the sliding cylinder 218 at the first position (e.g., downhole position). Further, contact between the uphole face 232 of the stop plate 226 and the uphole end 238 of the central chamber 236 restrains uphole movement of the sliding cylinder 218 at the second position (e.g., uphole position). In some embodiments, a portion of the main body of the anchor 200 forms the uphole end 238 of the central chamber 236.

Moreover, an interface (shown in FIGS. 3-5) between the sliding cylinder 218 and the main body 220 and/or spring housing 222 is configured to restrain rotational movement of the sliding cylinder 218 with respect to the main body 220. As an uphole portion 250 of the sliding cylinder 218 is coupled to the coiled tubing 106, the interface between the sliding cylinder 218 and the main body 220 and/or spring housing 222 may also restrain rotation of the coiled tubing 106 with the anchor 200 in the set state. During milling operations, reactionary forces (e.g., torque) from the reamer 204 may be transferred via the motor 208 and the sliding cylinder 218 to the interface instead of to the coiled tubing 106, which prevent twisting and/or other adverse conditions for the coiled tubing 106.

As set forth above, FIG. 2A illustrates the section milling system 112 in a set state. Specifically, the illustrated embodiment shows the section milling system 112 disposed in the desired position in the wellbore 108 with fluid is flowing into the section milling system 112 from the surface, via the coiled tubing 106, at the second flow rate. Accordingly, the hydraulic pads 202 of the anchor are extended radially outward to set the anchor 200. Further, the cutting arms 206 of the reamer 204 are in the extended position and the motor 208 is driving rotation of the cutting arms 206 such that the reamer 204 may mill the casing 116, the cement 118, and/or the wellbore 108 at the location of the reamer 204 (e.g., a lowered position). As the cutting arms 206 mill at the lowered position, fluid pressure may increase due to the motor 208 generating higher torque to mill through at least the casing 116. In some embodiments, the section milling system may include sensors 252 to detect the fluid pressure and provide sensor data to the surface.

FIG. 2B illustrates the actuation feature 214 pulling the reamer 204 in the uphole direction 216 such that the reamer 204 may mill the casing 116, the cement 118, and/or the wellbore wall 122 between the lowered position and a raised position. In the raised position, a spring 254 of the actuation feature 214 may be compressed such that the stop plate 226 of the sliding cylinder 218 may be disposed proximate the main body 220 of the anchor 200. Moreover, the actuation feature 214 may be configured to pull the reamer 204 in the uphole direction 216 once the cutting arms 206 are in the extended position and the cutting arms 206 having milled the casing 116 at the lowered position). For example, once the cutting arms 206 have milled the casing 116 at the lowered position, the sensors 252 may detect a decrease in pressure since the motor 208 is no longer generating the higher torque to mill through the casing 116. The detected decrease in pressure may provide an indication to the surface that the reamer 204 is ready to be pulled uphole to the raised position. Accordingly, the actuation feature 214 may be activated to pull the reamer 204 in the uphole direction 216.

As set forth above, an uphole portion 250 of the sliding cylinder 218 may be coupled to the coiled tubing 106 such that movement of the coiled tubing 106 may move the sliding cylinder 218 between the first position and the second position, which may move the reamer 204 between the lowered position and the raised position, respectively. Indeed, as illustrated, a downhole portion 256 of the sliding cylinder 218 may be coupled to the motor 208 and the motor 208 may be coupled to the reamer 204 such that axial movement of the coiled tubing 106 is configured to drive axial movement of the reamer 204.

However, axial movement of the reamer 204 may be limited by the sliding cylinder 218. As set forth above, contact between the stop plate 226 of the sliding cylinder 218 and the downhole end 246 of the central chamber 236 of the spring housing 222 restrains downhole movement of the sliding cylinder 218 at the first position (e.g., downhole position), and contact between the stop plate 226 and the uphole end 238 of the central chamber 236 may restrain uphole movement of the sliding cylinder 218 at the second position (e.g., uphole position). In some embodiments, the spring 254 may be disposed between the uphole end 238 of the central chamber 236 and the stop plate 226 such that the spring 254 in a fully compressed state may restrain uphole movement of the sliding cylinder 218 at the uphole position. Accordingly, as the coiled tubing 106, the motor 208, and the reamer 204 are coupled either directly or indirectly to the sliding cylinder 218, limiting movement of the sliding cylinder 218 between the first position and the second position also limits the axial movement of the coiled tubing 106, the motor 208, and the reamer 204. Thus, the axial movement of the reamer 204 may be limited to the lowered position (e.g., corresponding to the first position of the sliding cylinder 218) and the raised position (e.g., corresponding to the second position of the sliding cylinder 218). In the illustrated embodiment, the sliding cylinder 218 is disposed in the second position and the reamer 204 is disposed in the raised position.

Moreover, as the actuation feature 214 pulls the reamer 204 uphole toward the raised position, fluid may continue to flow into the section milling system 112 at the second flow rate such that the cutting arms 206 are maintained in the extended position for milling the casing 116. Once the reamer 204 reaches the raised position, as shown, the surface may observe a high pick-up force in combination with the sensors 252 showing no pressure increase, which may provide an indication that the reamer 204 is in the raised position and that the section milling system 112 is ready to disengage and reset.

FIG. 2C illustrates the anchor 200 in the released state. During some milling operations, a desired section of the casing 116 to be milled may be greater than the stroke length of the section milling system 112 (e.g., the distance between the lowered position and the raised position of the reamer 204.) As such, the section milling system 112 may be configured to shift and reset, such that the reamer 204 may continue to mill in the uphole direction 216. That is, the section milling system 112 may shift and reset in response to the reamer 204 moving to the raised position since the contact between the stop plate 226 and the uphole end 238 of the central chamber 236 restrains further uphole movement of the reamer 204.

Generally, the section milling system 112 is shifted and reset by holding the coiled tubing 106 in place, shifting the main body 220 and the spring housing 222 of the anchor 200 axially upward with respect to the sliding cylinder 218, and then setting the anchor 200 in the new position. Specifically, shifting and resetting the section milling system 112 comprises stopping fluid flow from the surface into the section milling system 112. Without the fluid flowing at least at the first flow rate, the hydraulic pads 202 of the anchor 200 retract such that the anchor 200 is in the released state. In the illustrated embodiment, fluid may flow through the central chamber 236 and to the hydraulic pads 202 via a sliding bore 258 formed in the main tubing 228 of the sliding cylinder 218. Moreover, in the released state, the main body 220 and spring housing 222 of the anchor 200 may move axially with respect to the wellbore 108. However, as set forth above, the coiled tubing 106 is held in place via the actuation feature 214. As such, the sliding cylinder 218, the motor 208, and the reamer 204 may be held in place with the anchor 200 in the released state.

Moreover, as illustrated, the anchor 200 may comprise the spring 254 (e.g., compression spring) disposed within the spring housing 222 between the stop plate 226 and the uphole end 238 of the central chamber 236 of the spring housing 222. The spring 254 is configured to bias the main body 220 of the anchor 200 axially away from the stop plate 226. As set forth above, the stop plate 226 of the sliding cylinder 218 is maintained in position via the coiled tubing 106. Accordingly, the spring 254 is configured to drive the main body 220 of the anchor 200 in the uphole direction 216 with respect to the sliding cylinder 218. The spring 254 is configured to drive the main body 220 in the uphole direction 216, to shift the anchor 200 uphole in the wellbore 108, until the downhole end 246 of the central chamber 236 of the spring housing 222 contacts the downhole face 234 of the stop plate 226. Consequently, with the sliding cylinder 218 in the first position, the reamer 204 is disposed in the lowered position with respect to the anchor 200. Accordingly, the section milling system 112 is shifted, reset, and ready to repeat the section milling process. That is, the section milling system 112 is ready to set the anchor 200 and extend the cutting arms 206 to continue milling uphole from the new lowered position to a new raised position.

Figure 3:
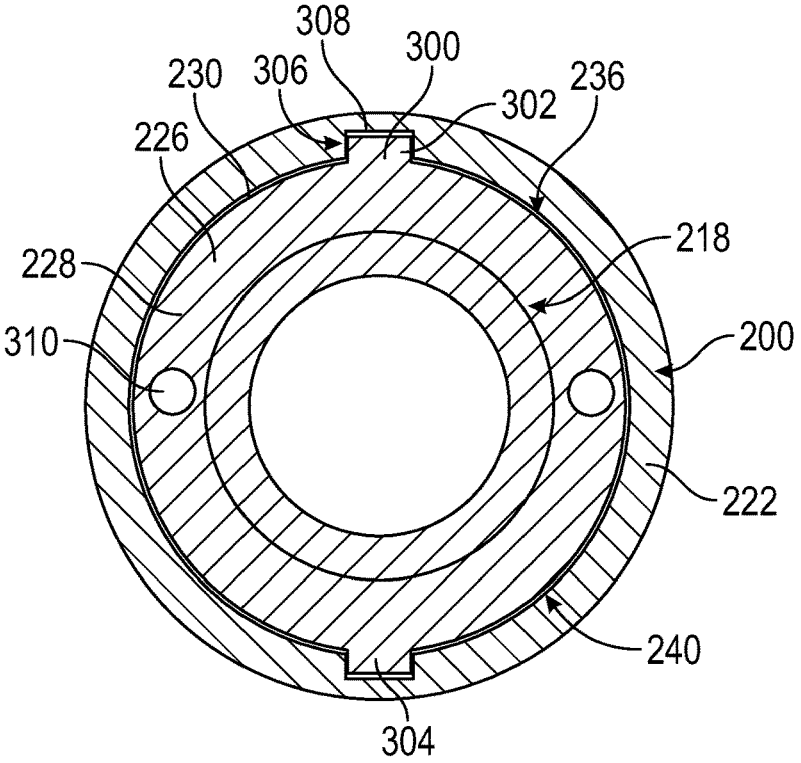
FIG. 3 illustrates a cross-sectional view of a stop plate of a sliding cylinder disposed in a spring housing, in accordance with some embodiments of the present disclosure.

FIG. 3 illustrates a cross-sectional view of the stop plate 226 of the sliding cylinder 218 disposed in the spring housing 222, in accordance with some embodiments of the present disclosure. As illustrated, the stop plate 226 extends radially outward from the main tubing 228 of the sliding cylinder 218 to form an annular ring shape around the main tubing 228. In the illustrated embodiment, the stop plate 226 extends radial outward to a position proximate the inner surface 240 of the spring housing 222. However, the stop plate 226 may comprise any suitable shape. Moreover, the stop plate 226 may include at least one radial protrusion 300 extending radially outward from the radially outer surface 230 of the stop plate 226. In the illustrated embodiment, the stop plate 226 comprises a first radial protrusion 302 and a second radial protrusion 304 disposed one-hundred and eighty degrees apart. However, the radial protrusions 302, 304 may have any suitable spacing between each other.

As set forth above, the interface 306 between the sliding cylinder 218 and the main body (shown in FIG. 5) and/or the spring housing 222 is configured to restrain rotational movement of the sliding cylinder 218 with respect to the main body 220 and the spring housing 222, which also restrains rotation of the coiled tubing 106 when the anchor 200 is in the set state. In the illustrated embodiment, the stop plate 226 comprises the at least one radial protrusion 300. Further, the spring housing 222 comprises at least one corresponding slot 308 that extends axially along on the inner surface 240 of the spring housing 222. As illustrated, the interface 306 configured to restrain rotational movement of the sliding cylinder 218 with respect to the main body 220 may be formed between the at least one radial protrusion 300 and the at least one corresponding slot 308. In particular, the at least one radial protrusion 300 may be disposed at least partially within the at least one corresponding slot 308 such that a portion of the at least one radial protrusion 300 may contact a corresponding portion of the at least one corresponding slot 308 to restrain rotation of the stop plate 226 with respect to the spring housing 222.

Moreover, the stop plate 226 may include at least one bypass hole 310 to permit fluid to flow through the stop plate 226. The central chamber 236 of the spring housing 222 may be filled with fluid. Indeed, a flow path to the hydraulic pads 202 may include the central chamber 236. Specifically, the sliding bore 258 (shown in FIG. 2C) may be positioned within the central chamber 236 with the sliding cylinder 218 in the first position. Fluid may pass into the central chamber 236 from the sliding bore 258 and flow into the main body 220 to flow to each hydraulic pad 202. As the central chamber 236 is filled with fluid, permitting fluid to flow through the stop plate 226 may allow the stop plate 226 to slide axially within the central chamber 236 between the first position and the second position. Moreover, in some embodiments, the sliding bore 258 may be positioned on the main tubing 228 such that the sliding bore 258 is disposed outside of the central chamber 236 in the second position of the sliding cylinder 218. Without the sliding bore 258 disposed within the central chamber 236, sufficient fluid pressure to set the anchor 200 may cease such that the section milling system 112 may automatically release the anchor 200 to shift and release the section milling system 112 when the reamer 204 reaches the raised position.

Figure 4:
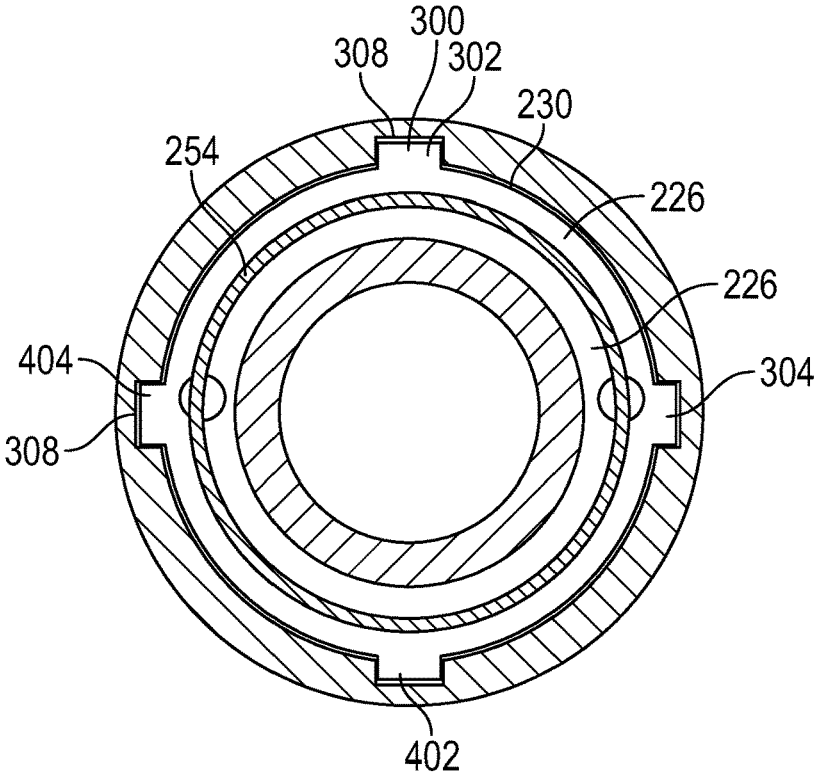
FIG. 4 illustrates a cross-sectional view of the stop plate comprising a plurality of protrusions configured to interface with corresponding grooves of the spring housing, in accordance with some embodiments of the present disclosure.

FIG. 4 illustrates a cross-sectional view of the stop plate 226 comprising a plurality of radial protrusions 300 configured to interface with corresponding slots 308 of the spring housing 222, in accordance with some embodiments of the present disclosure. As set forth above, the stop plate 226 may include the at least one radial protrusion 300 extending radially outward from the radially outer surface 230 of the stop plate 226. In the illustrated embodiment, the stop plate 226 comprises the first radial protrusion 302, the second radial protrusion 304, a third radial protrusion 402, and a fourth radial protrusion 404, each extending radially outward from the radially outer surface 230 of the stop plate 226. However, the at least one radial protrusion 300 may include any number of radial protrusions. Further, in the illustrated embodiment, the radial protrusions (e.g., the first radial protrusion 302, the second radial protrusion 304, the third radial protrusion 402, and the fourth radial protrusion 404) are disposed evenly about the stop plate 226. However, the radial protrusions 300 may have any suitable spacing between each other.

Figure 5:
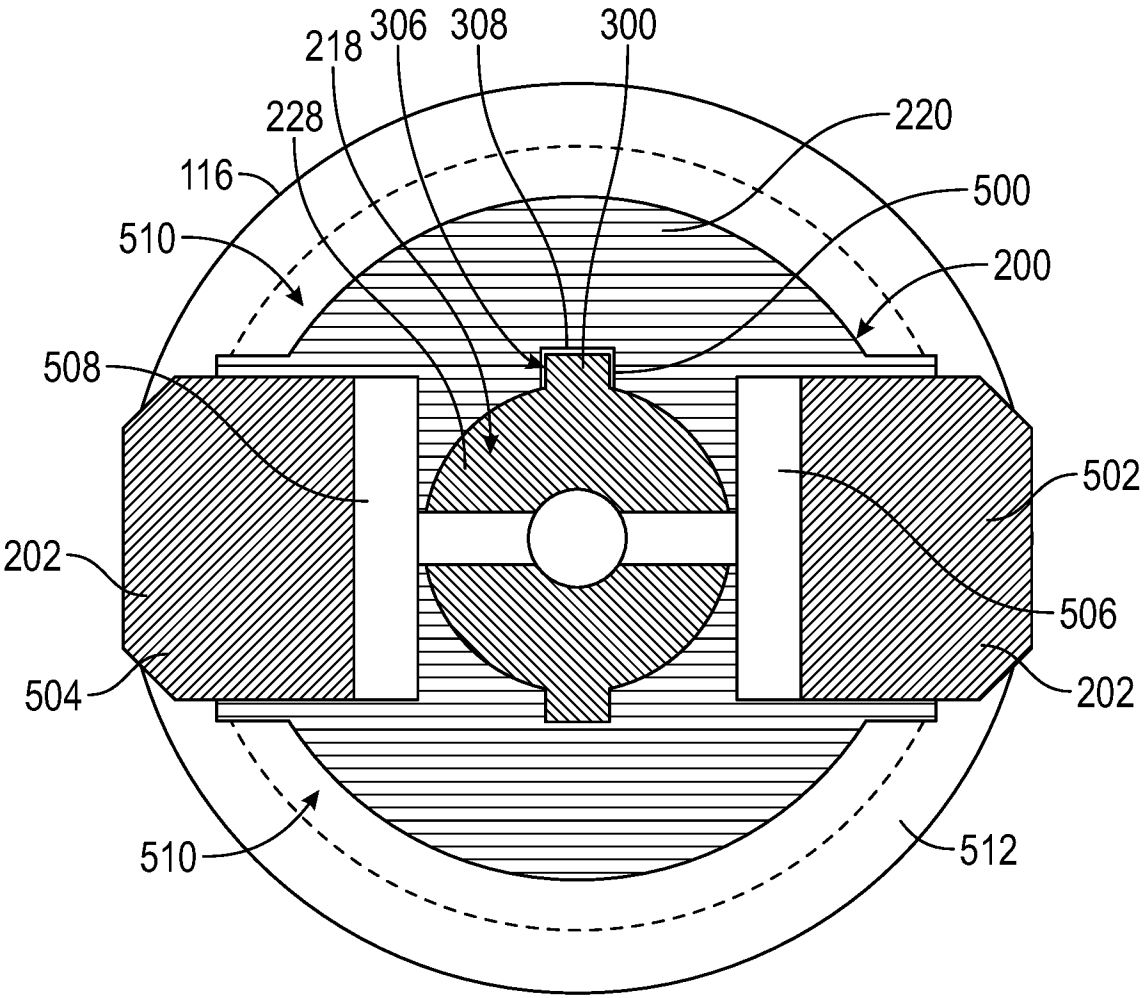
FIG. 5 illustrates a cross-sectional view of a main body of the anchor interfacing with the sliding cylinder, in accordance with some embodiments of the present disclosure.

FIG. 5 illustrates a cross-sectional view of the main body 220 of the anchor 200 interfacing with the sliding cylinder 218, in accordance with some embodiments of the present disclosure. As illustrated, the main tubing 228 of the sliding cylinder 218 may alternatively, or additionally, include the at least one radial protrusion 300. Further, the main body 220 of the anchor may comprise the at least one corresponding slot 308, which may extend axially along an inner body surface 240 of the main body 220. The interface 306 between the at least one radial protrusion 300 and the at least one corresponding slot 308 is configured to restrain rotation of the sliding cylinder 218, which also restrains rotation of the coiled tubing 106 when the anchor 200 is in the set state.

Moreover, as set forth above, the anchor 200 comprises the hydraulic pads 202 (e.g., a first hydraulic pad 502 and a second hydraulic pad 504) configured to expand radially outward to secure the anchor 200 against the casing 116 in response to the fluid flowing into the anchor 200 from the coiled tubing 106 at a first flow rate. In some embodiments, the anchor 200 may have additional hydraulic pads 202. Moreover, as set forth above, the first flow rate is configured to apply sufficient pressure to actuate the hydraulic pads 202 radially outward to set the anchor 200. Specifically, the first flow rate may be configured to generate sufficient pressure within the respective first and second pad chambers 506, 508 such that the hydraulic pads 202 actuate radially outward with sufficient force to set the anchor 200.

Additionally, the anchor 200 may comprise at least one bypass channel 510 to permit fluid to flow through the anchor 200 from a downhole zone to an uphole zone of the wellbore 108 with respect to the anchor 200. During milling operations, fluid may flow from the surface, through the coiled tubing 106, through the section milling system 112, and then back toward the surface via a wellbore annulus 512 formed between the section milling system 112 and the casing 116. However, in some embodiments, the hydraulic pads 202 and/or other portions of the anchor 200 may block fluid flow through the wellbore annulus 512 toward the surface. Thus, to provide a flow path for the fluid flowing toward the surface through the wellbore annulus 512, the anchor 200 may comprise the at least one bypass channel 510.

Figure 6C:
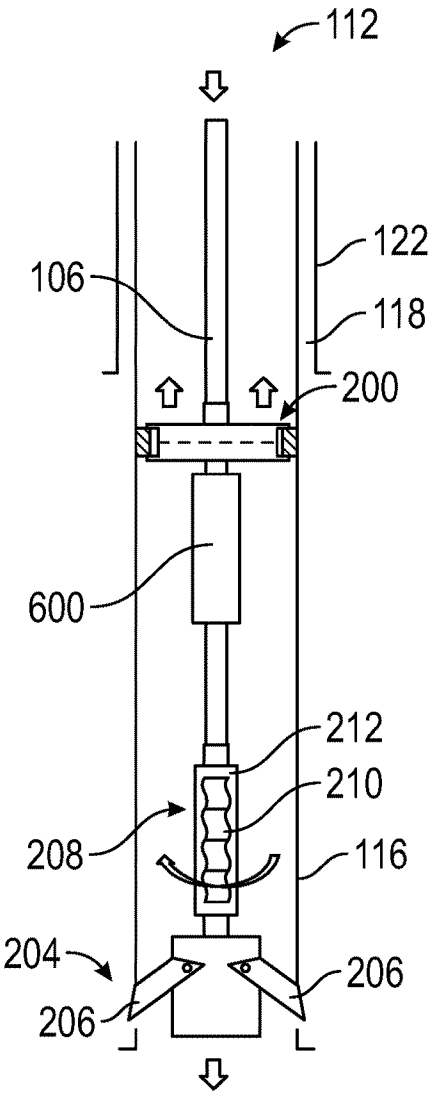
FIGS. 6A-G illustrate respective side views of a section milling system having a hydraulic actuation feature, in accordance with some embodiments of the present disclosure.
Figure 6B:
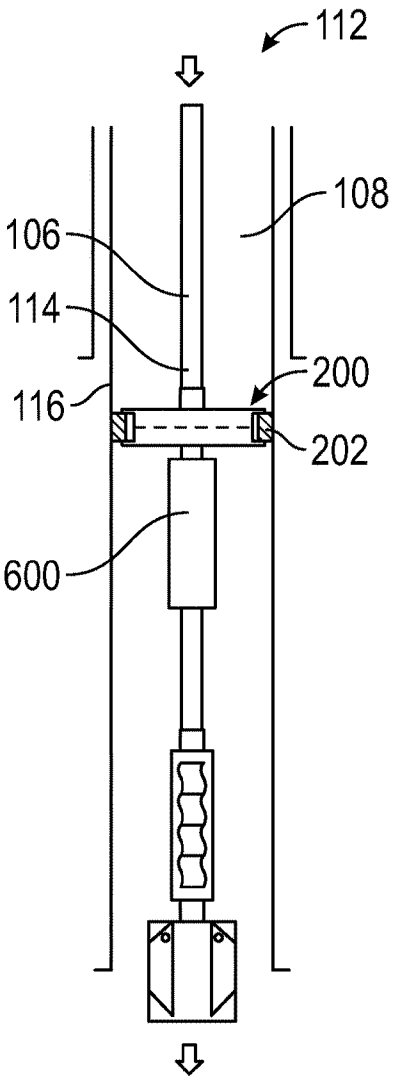
Figure 6A:
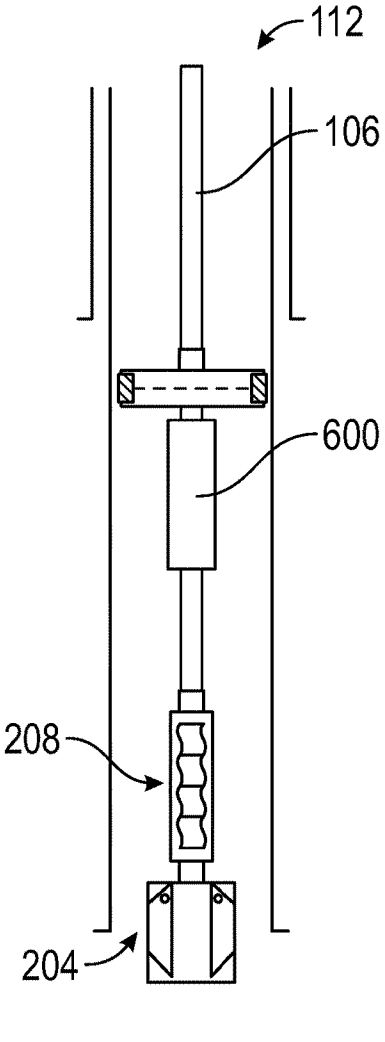

FIGS. 6A-G illustrate respective side views of the section milling system 112 having a hydraulic actuation feature 600, in accordance with some embodiments of the present disclosure. FIG. 6A illustrates the section milling system 112 being run-in-hole to the desired position for milling operations. In particular, the section milling system 112 may be run-in-hole via the coiled tubing 106. As illustrated, the section milling system 112 comprises the anchor 200 secured to the downhole end 114 of the coiled tubing 106. However, the coiled tubing 106 may be secured to any component (e.g., the motor 208, the hydraulic actuation feature 600, the reamer 204, etc.) of the section milling system 112.

FIG. 6B illustrates the section milling system 112 setting the anchor 200. As set forth above, the anchor 200 is secured to a downhole end 114 of the coiled tubing 106. Once the coiled tubing 106 lowers the anchor 200 into the wellbore 108 to a desired position, the anchor 200 is configured to expand radially outward to set the anchor 200 at the desired position and restrain rotation of the coiled tubing 106 during section milling operations. Specifically, setting the anchor 200 against the casing 116 may restrain both axial and rotational movement of the anchor 200 with respect to the wellbore 108. Further, the coiled tubing 106 may be rotational fixed with respect to the anchor 200 such that restraining rotation of the anchor 200 may restrain rotation of the coiled tubing 106. For example, the coiled tubing 106 may be rotationally fixed with respect to the anchor 200 via a threaded interface, a splined interface, or any suitable interface.

As illustrated, the anchor 200 may include the hydraulic pads 202 configured to expand radially outward to set or secure the anchor 200 at the desired position in the wellbore 108. However, any suitable mechanism may be used to set the anchor 200. With the anchor 200 in the desired position, fluid may be pumped from the surface and into the section milling system 112 via the coiled tubing 106 to set the anchor 200. Specifically, fluid is pumped into the section milling system 112 at the first rate, which is configured to apply sufficient pressure to actuate the hydraulic pads 202 radially outward against the casing 116 at the desired position to set the anchor 200. In the illustrated embodiment, the hydraulic pads 202 are fully actuated to set the anchor 200 at the desired position.

FIG. 6C illustrates the section milling system 112 with the reamer 204 extending the cutting arms 206. As illustrated, the reamer 204 may be positioned downhole from the anchor 200 and may be indirectly coupled to the anchor 200 via the motor 208 and the hydraulic actuation feature 600. The reamer 204 includes the plurality of extendable cutting arms 206 configured to extend radially outward in response to a sufficient rate of fluid flow through the reamer 204 (e.g., the second flow rate). The second flow rate may be greater than the first flow rate such that the anchor 200 may set before the cutting arms 206 actuate to an extended position. In the extended position, the cutting arms 206 are configured to engage the casing 116.

As set forth above, the motor 208 is configured to activate (e.g., rotate) in response to fluid flow through the motor 208 from the coiled tubing 106. The motor 208 may be disposed between the reamer 204 and the hydraulic actuation feature 600. However, the motor 208 may be disposed in any suitable position on the section milling system 112. Further, the motor 208 (e.g., the downhole mud motor) may include the rotor 210 disposed in the rotor housing 212. In response to fluid flow through the rotor housing 212, the rotor 210 is configured to rotate with respect to the rotor housing 212. Further, the motor 208 may be coupled to the reamer 204 such that rotation of the rotor 210 drives the reamer 204. Specifically, rotation of the rotor 210 may be configured to drive rotation of the cutting arms 206 of the reamer 204 in the extended position such that the cutting arms 206 may mill the wellbore casing 116, the cement 118, and/or the wellbore wall 122 positioned adjacent the reamer 204.

In the illustrated embodiment, the fluid flow rate into the section milling system 112 is increasing from the first flow rate to the second flow rate. Accordingly, the cutting arms 206 are extending radially outward. Further, the motor 208 is driving rotation of the cutting arms 206, which may mill portions of the casing 116, the cement 118, and/or the wellbore 108 at the location of the reamer 204 (e.g., the lowered position) as the cutting arms 206 extend outward to the extended position.

Figure 6F:
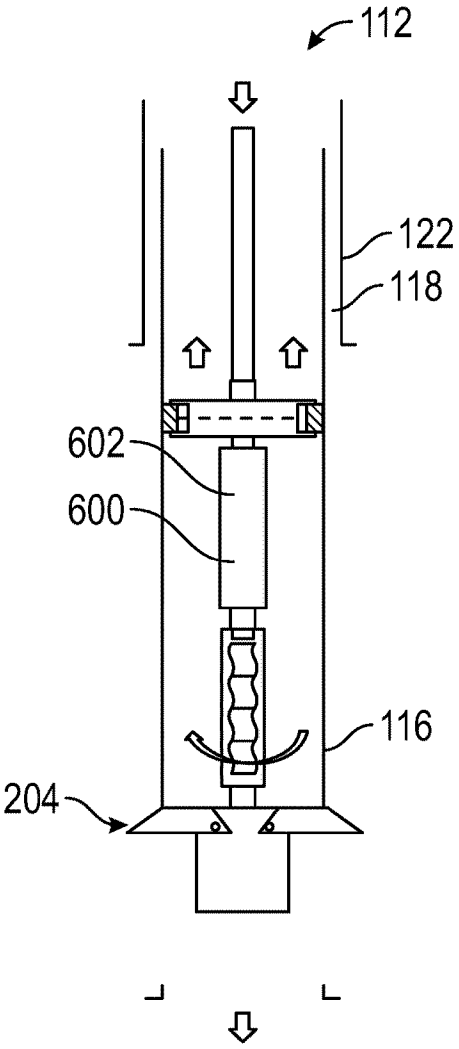
Figure 6E:
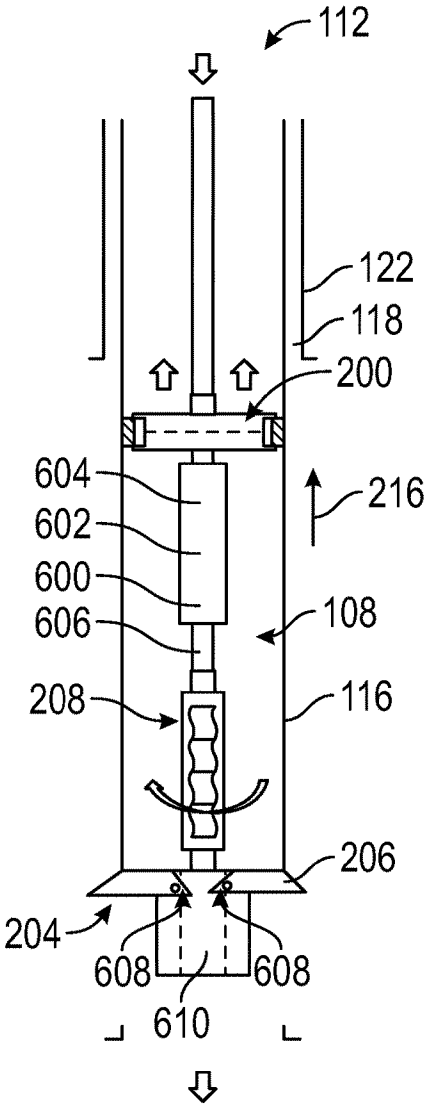
Figure 6D:
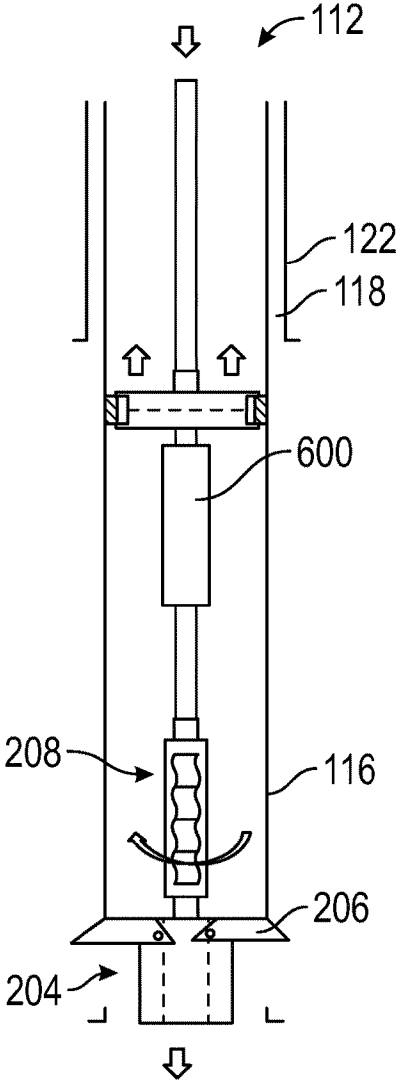

FIG. 6D illustrates the section milling system 112 with the cutting arms 206 in the extended position and the motor 208 driving rotation of the reamer 204. In the illustrated embodiment, the fluid is flowing into the section milling system 112 at the second flow rate, which is greater than the first flow rate. Further, the cutting arms 206 of the reamer 204 are in the extended position and the motor is driving rotation of the cutting arms 206 such that the reamer may mill the casing 116, the cement 118, and/or the wellbore 108 at the location of the reamer 204 (e.g., the lowered position).

FIG. 6E illustrates the hydraulic actuation feature 600 activated to pull the reamer 204 in the uphole direction 216 from the lowered position to the raised position. As set forth above, the section milling system 112 includes the hydraulic actuation feature 600 configured to move the reamer 204 in the uphole direction 216 with respect to the anchor 200 to mill along the wellbore 108 in the uphole direction 216. That is, with the cutting arms 206 in the extended position and the motor 208 driving rotation of the cutting arms 206, hydraulic actuation feature 600 may pull the reamer 204 in the uphole direction 216 such that the cutting arms 206 may mill the wellbore casing 116, the cement 118, and or the wellbore wall 122 as the reamer 204 moves uphole from the lowered position to the raised position. In the illustrated embodiment, the hydraulic actuation feature 600 is disposed downhole and comprises a hydraulic stroker 602 for pulling the reamer 204 in the uphole direction 216.

The hydraulic stroker 602 may be disposed between the anchor 200 and the reamer 204. Specifically, an uphole portion 604 of the hydraulic stroker 602 may be coupled to the anchor 200 and a downhole portion 606 of the hydraulic stroker 602 may be coupled directly to the reamer 204 or coupled indirectly to the reamer 204 via the motor 208. Further, the downhole portion 606 of the hydraulic stroker 602 is configured to move axially with respect to the uphole portion 604 of the hydraulic stroker 602. In some embodiments, the downhole portion 606 is configured to retract from a first position (e.g., corresponding to the lowered position of the reamer 204) to a second position (e.g., corresponding to the raised position of the reamer 204). Indeed, the hydraulic stroker 602 may be configured to retract to pull the reamer 204 in the uphole direction 216 with respect to the anchor 200 to mill along the wellbore 108 in the uphole direction 216.

The hydraulic stroker 602 may be configured to retract in response to a pressure (e.g., in the hydraulic stroker 602) exceeding a threshold activation pressure. In some embodiments, the threshold activation pressure is greater than the pressure generated by the first and second flow rates into the section milling system 112. As such, the hydraulic stroker 602 may not immediately activate in response to fluid flowing through the hydraulic stroker 602 at the first or second flow rate. In the illustrated embodiment, the hydraulic stroker 602 is configured to activate in response to fluid flowing into the section milling system 112 at least at the second flow rate and the cutting arms 206 of the reamer 204 extending into the extended position.

That is, in the extended position, inner ends 608 of the cutting arms 206 may pivot into a flow path 610 through the reamer 204 and restrict fluid flow through the reamer 204. In response to restricting fluid flow through the reamer 204, pressure in the flow path uphole from the reamer 204 may increase. Specifically, the pressure through the hydraulic stroker 602 may increase to the threshold activation pressure, which may activate the hydraulic stroker 602 to retract from the first position to the second position and correspondingly pull the reamer 204 in the uphole direction 216 from the lowered position to the raised position. In the illustrated embodiment, the hydraulic stroker 602 is retracting toward the second position.

In some embodiments, the section milling system 112 may comprise alternative or additional features for increasing the pressure in the hydraulic stroker 602 to the threshold activation pressure. For example, a section milling system 112 may include a ball drop system (not shown). In particular, a ball may be dropped into the flow path and land on a seat disposed downhole from the hydraulic stroker 602 and at least partially restrict flow past the ball. As set forth above, restricting the flow downhole the hydraulic stroker 602 may increase the pressure in the hydraulic stroker 602 to the threshold activation pressure. Further, the ball may comprise a dissolvable composition such that the ball may dissolve over time to cease restricting flow and the section milling system 112 may be reset. In another example, the flow rate into the section milling system 112 may be increased to a third flow rate, which may increase the pressure in the hydraulic stroker 602 to the threshold activation pressure. Any suitable system may be used for increasing the pressure in the hydraulic stroker 602 to the threshold activation pressure and/or activating the hydraulic stroker 602.

FIG. 6F illustrates the hydraulic actuation feature 600 (e.g., the hydraulic stroker 602) in a fully retracted position. With the pressure in the hydraulic stroker 602 held at or above the threshold activation pressure, the hydraulic stroker 602 may continue to retract until the hydraulic stroker 602 reaches the second position (e.g., a fully retracted position). As set forth above, retracting the hydraulic stroker 602 pulls the reamer 204 to the raised position such that the reamer 204 may mill the casing 116 between the lowered position and the raised position. In the illustrated embodiment, the reamer 204 is disposed in the raised position.

Figure 6G:
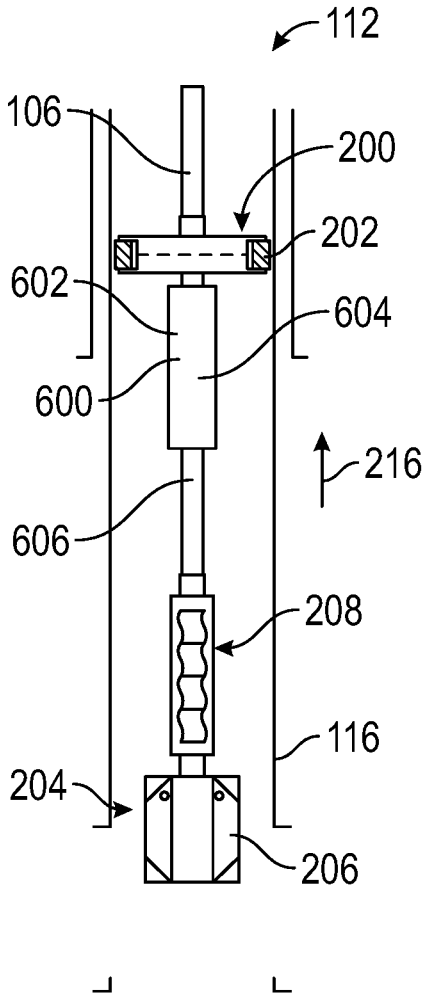

FIG. 6G illustrates the section milling system 112 in the released position and repositioned to continue milling operations along the wellbore 108. As set forth above, during some milling operations, a desired section of the casing 116 to be milled may be greater than the stroke length of the section milling system 112 (e.g., the distance between the lowered position and the raised position of the reamer 204.) As such, the section milling system 112 may be configured to shift and reset such that the reamer 204 may continue to mill in the uphole direction 216. That is, the section milling system 112 may shift and reset in response to the reamer 204 moving to the raised position since the hydraulic actuation feature 600 (e.g., the hydraulic stroker 602) is fully retracted and may not pull the reamer 204 further uphole.

Generally, the section milling system 112 is shifted and reset by reducing fluid flow into the section milling system 112 to a flow rate below the first flow rate or cutting fluid flow into the section milling system 112. Reducing the flow rate may cause the cutting arms 206 of the reamer 204 to retract and the hydraulic pads 202 to move from the set position to a released position. Further, the reduced flow rate may result in a pressure in the hydraulic stroker 602 to fall below the threshold activation pressure such that the downhole portion 606 of the hydraulic stroker 602 moves from the second position to the first position with respect to the uphole portion 604. Moreover, the motor 208 may slow or stop rotation. With the anchor 200 released and the cutting arms 206 retracted, the section milling system 112 may then be pulled uphole via the coiled tubing 106 to a new desired position. Accordingly, the section milling system 112 is shifted, reset, and ready to repeat the section milling process. That is, the section milling system 112 is ready to set the anchor 200 and extend the cutting arms 206 to continue milling uphole from the new lowered position to a new raised position.

Accordingly, the present disclosure may provide a section milling systems and methods that restrain rotation of the coiled tubing, used to run the section milling system in-hole, to reduce reactionary forces on the coiled tubing. The systems and methods may include any of the various features disclosed herein, including one or more of the following statements.

Statement 1. A section milling system, comprising: an anchor secured to a downhole end of a coiled tubing, wherein the anchor is configured to expand radially outward to set the anchor at a downhole position and restrain rotation of the coiled tubing; a reamer positioned downhole from the anchor, wherein the reamer comprises cutting arms configured to extend radially outward in response to fluid flowing through the reamer; a motor configured to rotate in response to fluid flowing through the motor from the coiled tubing, wherein rotation of the motor is configured to drive rotation of the cutting arms of the reamer to mill wellbore casing positioned adjacent the reamer; and an actuation feature configured to move the reamer in an uphole direction with respect to the anchor to mill along a wellbore in the uphole direction.

Statement 2. The section milling system of statement 1, wherein the anchor comprises a main body, a spring housing extending from a downhole end of the main body, and a sliding cylinder extending through the main body and the spring housing, wherein the sliding cylinder is configured to move axially, with respect to the main body and the anchor, between a first position and a second position.

Statement 3. The section milling system of statement 2, wherein an interface between the sliding cylinder and the main body and/or spring housing is configured to restrain rotational movement of the sliding cylinder with respect to the main body, and wherein an uphole end of the sliding cylinder is configured to couple to the coiled tubing such that the anchor restrains rotation of the coiled tubing in a set state.

Statement 4. The section milling system of statement 2 or statement 3, wherein a downhole end of the sliding cylinder is coupled to the motor, and wherein the motor is coupled to the reamer such that axial movement of the sliding cylinder is configured to drive axial movement of the reamer.

Statement 5. The section milling system of any of statements 2-4, wherein the sliding cylinder comprises a stop plate extending radially outward from the sliding cylinder, wherein the stop plate is disposed within a central chamber of the spring housing, wherein contact between the stop plate and a first end of the central chamber restrains downhole movement of the sliding cylinder at the first position, and wherein contact between the stop plate and a second end of the central chamber restrains uphole movement of the sliding cylinder at the second position.

Statement 6. The section milling system of statement 5, wherein the stop plate comprises at least one radial protrusion, wherein the spring housing comprises at least one corresponding slot that extends axially along on inner surface of the spring housing, wherein an interface between the at least one radial protrusion and the at least one corresponding slot is configured to restrain rotation of the sliding cylinder.

Statement 7. The section milling system of statement 5 or statement 6, wherein the anchor comprises a spring disposed within the spring housing between the stop plate and the second end of the central chamber of the spring housing, wherein the spring is configured to bias the main body of the anchor axially away from the stop plate, wherein the spring is configured to drive the main body, in response to the anchor transitioning from a set state to a released state, in an uphole direction with respect to the sliding cylinder until the sliding cylinder is disposed in the first position.

Statement 8. The section milling system of any of statements 2-7, wherein a main tubing of the sliding cylinder comprises at least one radial protrusion, wherein the main body and/or spring housing comprises at least one corresponding slot that extends axially along on inner surface of the main body and/or spring housing, wherein an interface between the at least one radial protrusion and the at least one corresponding slot is configured to restrain rotation of the sliding cylinder.

Statement 9. The section milling system of any preceding statement, wherein the anchor comprises bypass channels to permit fluid to flow through from a portion of the wellbore positioned downhole from the anchor to a portion of the wellbore positioned uphole from the anchor.

Statement 10. The section milling system of any preceding statement, wherein the motor comprises a downhole mud motor configured to rotate to drive the reamer in response to fluid flow through the motor.

Statement 11. The section milling system of any preceding statement, wherein the anchor comprises hydraulic pads configured to expand radially outward to secure the anchor in response to the fluid flowing into the anchor from the coiled tubing at a first flow rate.

Statement 12. The section milling system of statement 11, wherein the cutting arms of the reamer are configured extend radially outward at a second flow rate of the fluid, wherein the second flow rate is greater than the first flow rate, and wherein the motor is configured to rotate to drive the reamer at the second flow rate.

Statement 13. The section milling system of any preceding statement, wherein the actuation feature comprises a surface system configured to move the coiled tubing uphole, wherein the reamer is coupled directly or indirectly to the coiled tubing such that uphole movement of the coiled tubing moves the reamer in the uphole direction to mill along the wellbore in the uphole direction.

Statement 14. The section milling system of any of statements 1 or 9-12, wherein the actuation feature comprises a hydraulic stroker.

Statement 15. A section milling system, comprising: an anchor secured to a downhole end of a coiled tubing, wherein the anchor is configured to expand radially outward to secure the anchor at a downhole position and restrain rotation of the coiled tubing; a reamer having cutting arms, wherein the cutting arms are configured to extend radially outward to an open state in response to fluid flowing through the reamer; a motor configured to rotate in response to fluid flowing through the motor from the coiled tubing, wherein rotation of the motor is configured to drive rotation of the cutting arms of the reamer to mill wellbore casing positioned adjacent the reamer; and a hydraulic stroker disposed between the anchor and the reamer, wherein the hydraulic stroker is configured to retract to pull the reamer in an uphole direction with respect to the anchor to mill along a wellbore in the uphole direction.

Statement 16. The section milling system of statement 15, wherein the anchor comprises hydraulic pads configured to expand radially outward to secure the anchor in response to the fluid flowing into the anchor from the coiled tubing at a first flow rate, wherein the cutting arms of the reamer are configured extend radially outward to the open state at a second flow rate of the fluid, wherein the second flow rate is greater than the first flow rate, and wherein the motor is configured to rotate to drive the reamer at the second flow rate.

Statement 17. The section milling system of statement 15 or statement 16, wherein the hydraulic stroker is configured to retract in response to pressure in the hydraulic stroker exceeding a threshold activation pressure, wherein the reamer is configured to restrict a flow path through the hydraulic stroker in the open state, and wherein the restricted flow path in configured to increase the pressure in the hydraulic stroker to the threshold activation pressure.

Statement 18. A method for section milling, comprising: running a section milling system into a wellbore to a downhole position via coiled tubing; setting an anchor of the section milling system via pumping fluid through the coiled tubing to the anchor at a first flow rate; expanding a reamer of the section milling system via pumping the fluid through the coiled tubing to the reamer at a second flow rate, wherein the second flow rate is greater than the first flow rate, and wherein expanding the reamer comprises extending cutting arms of the reamer radially outward to engage a wellbore casing; actuating a motor of the section milling system via pumping the fluid through the coiled tubing to the motor at the second flow rate, wherein the motor is coupled to the reamer, and wherein the motor is configured to drive rotation of the cutting arms of the reamer to mill the wellbore casing positioned adjacent the reamer; and pulling the reamer, via an actuation feature of the section milling system, in an uphole direction with respect to the anchor to mill along the wellbore in the uphole direction.

Statement 19. The method of statement 18, wherein pulling the reamer in the uphole direction comprises pulling the coiled tubing in the uphole direction via a surface system of the section milling system, and wherein the coiled tubing is coupled directly or indirectly to the reamer.

Statement 20. The method of statement 18, wherein pulling the reamer in the uphole direction comprises retracting a hydraulic stroker of the section milling system in response to a threshold pressure, and wherein the reamer is coupled to the hydraulic stroker.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A section milling system, comprising:

an anchor secured to a downhole end of a coiled tubing, wherein the anchor is configured to expand radially outward to set the anchor at a downhole position and restrain rotation of the coiled tubing, wherein the anchor comprises a main body, a spring housing extending from a downhole end of the main body, and a sliding cylinder extending through the main body and the spring housing, wherein the sliding cylinder is configured to move axially with respect to the main body of the anchor;

a reamer positioned downhole from the anchor, wherein the reamer comprises cutting arms configured to extend radially outward in response to fluid flowing through the reamer;

a motor configured to rotate in response to fluid flowing through the motor from the coiled tubing, wherein rotation of the motor is configured to drive rotation of the cutting arms of the reamer to mill wellbore casing positioned adjacent the reamer; and an actuation feature configured to move the reamer in an uphole direction with respect to the anchor to mill along a wellbore in the uphole direction.

2. The section milling system of claim 1, wherein an interface between the sliding cylinder and the main body and/or spring housing is configured to restrain rotational movement of the sliding cylinder with respect to the main body, and wherein an uphole end of the sliding cylinder is configured to couple to the coiled tubing such that the anchor restrains rotation of the coiled tubing in a set state.

3. The section milling system of claim 2, wherein a downhole end of the sliding cylinder is coupled to the motor, and wherein the motor is coupled to the reamer such that axial movement of the sliding cylinder is configured to drive axial movement of the reamer.

4. The section milling system of claim 3, wherein the sliding cylinder is configured to move axially, with respect to the main body of the anchor, between a first position and a second position, wherein the sliding cylinder comprises a stop plate extending radially outward from the sliding cylinder, wherein the stop plate is disposed within a central chamber of the spring housing, wherein contact between the stop plate and a first end of the central chamber restrains downhole movement of the sliding cylinder at the first position, and wherein contact between the stop plate and a second end of the central chamber restrains uphole movement of the sliding cylinder at the second position.

5. The section milling system of claim 4, wherein the stop plate comprises at least one radial protrusion, wherein the spring housing comprises at least one corresponding slot that extends axially along on inner surface of the spring housing, wherein an interface between the at least one radial protrusion and the at least one corresponding slot is configured to restrain rotation of the sliding cylinder.

6. The section milling system of claim 4, wherein the anchor comprises a spring disposed within the spring housing between the stop plate and the second end of the central chamber of the spring housing, wherein the spring is configured to bias the main body of the anchor axially away from the stop plate, wherein the spring is configured to drive the main body, in response to the anchor transitioning from a set state to a released state, in an uphole direction with respect to the sliding cylinder until the sliding cylinder is disposed in the first position.

7. The section milling system of claim 6, wherein a main tubing of the sliding cylinder comprises at least one radial protrusion, wherein the main body and/or spring housing comprises at least one corresponding slot that extends axially along on inner surface of the main body and/or spring housing, wherein an interface between the at least one radial protrusion and the at least one corresponding slot is configured to restrain rotation of the sliding cylinder.

8. The section milling system of claim 1, wherein the anchor comprises bypass channels to permit fluid to flow through from a portion of the wellbore positioned downhole from the anchor to a portion of the wellbore positioned uphole from the anchor.

9. The section milling system of claim 1, wherein the motor comprises a downhole mud motor configured to rotate to drive the reamer in response to fluid flow through the motor.

10. The section milling system of claim 1, wherein the anchor comprises hydraulic pads configured to expand radially outward to secure the anchor in response to the fluid flowing into the anchor from the coiled tubing at a first flow rate.

11. The section milling system of claim 10, wherein the cutting arms of the reamer are configured extend radially outward at a second flow rate of the fluid, wherein the second flow rate is greater than the first flow rate, and wherein the motor is configured to rotate to drive the reamer at the second flow rate.

12. The section milling system of claim 1, wherein the actuation feature comprises a surface system configured to move the coiled tubing uphole, wherein the reamer is coupled directly or indirectly to the coiled tubing such that uphole movement of the coiled tubing moves the reamer in the uphole direction to mill along the wellbore in the uphole direction.

13. The section milling system of claim 1, wherein the actuation feature comprises a hydraulic stroker.

14. A section milling system, comprising:

an anchor secured to a downhole end of a coiled tubing, wherein the anchor is configured to expand radially outward to secure the anchor at a downhole position and restrain rotation of the coiled tubing, wherein the anchor comprises a main body, a spring housing extending from a downhole end of the main body, and a sliding cylinder extending through the main body and the spring housing, wherein the sliding cylinder is configured to move axially with respect to the main body of the anchor;

a reamer having cutting arms, wherein the cutting arms are configured to extend radially outward to an open state in response to fluid flowing through the reamer;

a motor configured to rotate in response to fluid flowing through the motor from the coiled tubing, wherein rotation of the motor is configured to drive rotation of the cutting arms of the reamer to mill wellbore casing positioned adjacent the reamer; and a hydraulic stroker disposed between the anchor and the reamer, wherein the hydraulic stroker is configured to retract to pull the reamer in an uphole direction with respect to the anchor to mill along a wellbore in the uphole direction.

15. The section milling system of claim 14, wherein the anchor comprises hydraulic pads configured to expand radially outward to secure the anchor in response to the fluid flowing into the anchor from the coiled tubing at a first flow rate, wherein the cutting arms of the reamer are configured extend radially outward to the open state at a second flow rate of the fluid, wherein the second flow rate is greater than the first flow rate, and wherein the motor is configured to rotate to drive the reamer at the second flow rate.

16. The section milling system of claim 14, wherein the hydraulic stroker is configured to retract in response to pressure in the hydraulic stroker exceeding a threshold activation pressure, wherein the reamer is configured to restrict a flow path through the hydraulic stroker in the open state, and wherein the restricted flow path in configured to increase the pressure in the hydraulic stroker to the threshold activation pressure.

17. A method for section milling, comprising:

running a section milling system into a wellbore to a downhole position via coiled tubing;

setting an anchor of the section milling system via pumping fluid through the coiled tubing to the anchor at a first flow rate, wherein the anchor comprises a main body, a spring housing extending from a downhole end of the main body, and a sliding cylinder extending through the main body and the spring housing, wherein the sliding cylinder is configured to move axially with respect to the main body of the anchor;

expanding a reamer of the section milling system via pumping the fluid through the coiled tubing to the reamer at a second flow rate, wherein the second flow rate is greater than the first flow rate, and wherein expanding the reamer comprises extending cutting arms of the reamer radially outward to engage a wellbore casing;

actuating a motor of the section milling system via pumping the fluid through the coiled tubing to the motor at the second flow rate, wherein the motor is coupled to the reamer, and wherein the motor is configured to drive rotation of the cutting arms of the reamer to mill the wellbore casing positioned adjacent the reamer; and pulling the reamer, via an actuation feature of the section milling system, in an uphole direction with respect to the anchor to mill along the wellbore in the uphole direction.

18. The method of claim 17, wherein pulling the reamer in the uphole direction comprises pulling the coiled tubing in the uphole direction via a surface system of the section milling system, and wherein the coiled tubing is coupled directly or indirectly to the reamer.

19. The method of claim 17, wherein pulling the reamer in the uphole direction comprises retracting a hydraulic stroker of the section milling system in response to a threshold pressure, and wherein the reamer is coupled to the hydraulic stroker.

* * * * *